US005262795A

United States Patent [19]

DeMarre et al.

[11] Patent Number: 5,262,795

[45] Date of Patent: Nov. 16, 1993

[54] UNITARY CELLULAR ANTENNA SYSTEM

[75] Inventors: Allen G. DeMarre; Jack Evans, both of Mokena, Ill.

[73] Assignee: Cellular IC, Inc., Chicago, Ill.

[21] Appl. No.: 472,015

[22] Filed: Jan. 30, 1990

[51] Int. Cl.[5] ..... H01Q 1/12; H01Q 9/10

[52] U.S. Cl. ..... 343/829; 343/715; 343/848; 343/878

[58] Field of Search ..... 343/713, 715, 745, 846, 343/848, 829, 878, 830, 860, 861

[56] References Cited

U.S. PATENT DOCUMENTS

| | | | |
|---|---|---|---|
| 1,715,952 | 6/1929 | Rostron . | |
| 2,829,367 | 4/1958 | Rychlik . | |
| 4,089,817 | 5/1978 | Kirkendall | 343/713 |
| 4,095,231 | 6/1978 | Carter | 343/846 |
| 4,148,037 | 4/1979 | Britten | 343/846 |
| 4,238,799 | 12/1980 | Parfit | 343/713 |
| 4,620,194 | 10/1986 | Moratella . | |
| 4,658,259 | 4/1987 | Blaese | 343/715 |
| 4,779,098 | 10/1988 | Blaese | 343/715 |
| 4,785,305 | 11/1988 | Shyu | 343/715 |
| 4,794,319 | 12/1988 | Shimazaki | 343/715 |
| 4,857,939 | 8/1989 | Shimazaki | 343/715 |
| 4,868,576 | 9/1989 | Johnson | 343/702 |

FOREIGN PATENT DOCUMENTS

| | | | |
|---|---|---|---|
| 0137391 | 9/1984 | European Pat. Off. | 343/715 |
| 23242 | 2/1977 | Japan | 343/878 |

*Primary Examiner*—Michael C. Wimer

[57] ABSTRACT

The unitary cellular telephone antenna includes a junction box to which is mounted both the antenna element, preferably a $\frac{5}{8}$ wavelength antenna, and two $\frac{1}{4}$ wavelength downwardly oriented radials to establish the antenna's ground plane. Electrical elements are included within the junction box to match the impedance of the antenna system to the cellular telephone transceiver and to maximize the radiated signal.

1 Claim, 1 Drawing Sheet

UNITARY CELLULAR ANTENNA SYSTEM

BACKGROUND OF THE INVENTION

The present invention relates to a cellular telephone antenna, particularly one incorporating both antenna and ground plane elements.

As cellular telephone systems have grown in popularity, the telephone themselves have become smaller and smaller in size and more and more convenient to use. Presently a number of cellular telephones are completely contained within a hand held unit, and easily portable. Typically these portable cellular telephones incorporate a small antenna, one which while adequate in many applications is inadequate in applications requiring a low loss, high efficiency antenna especially for distant communications.

Various designs of cellular telephone antenna systems have been built and are in use today. One example of such an antenna is described in U.S. Pat. No. 4,794,319 to Shimazaki. In general, this type of cellular telephone antenna is designed for a permanent, fixed mount such as on the rear glass window of an automobile. It is not portable.

An objective of the present invention is to provide an antenna system for portable cellular telephones that offer high gain, and that is also portable. Another objective of the present invention is to provide a portable cellular telephone antenna system that incorporates both an antenna element and ground plane elements. These and other objects of the invention will appear from the following description of the preferred embodiment.

BRIEF SUMMARY OF THE INVENTION

The present invention provides a unitary cellular antenna assembly that mounts, on a junction box, a fractional wavelength antenna and a plurality of ground plane radial elements, the antenna and the elements being mounted on the junction box such that when the box is oriented to direct the antenna generally vertically upward the radial elements are angled downwardly relative to the horizontal plane established by the antenna.

In a preferred embodiment, the antenna and ground plane elements lie generally in the same plane, and the junction box includes means for removably attaching it to a surface. In addition, the preferred unitary cellular antenna assembly incorporates impedance matching elements to substantially match the output impedance of the cellular telephone transceiver to the input impedance of the antenna assembly. Further, the preferred assembly incorporates a $\frac{5}{8}$ wavelength antenna and at least two $\frac{1}{4}$ wavelength radial elements, which elements are downwardly directed at an angle of from 120 degrees to 150 degrees relative to the antenna.

BRIEF DESCRIPTION OF THE DRAWINGS

The invention will be further described in connection with the accompanying drawing in which.

DETAILED DESCRIPTION

The preferred unitary cellular telephone antenna is designed to be mounted on vehicle window or other supporting surface, and to be connected to a portable cellular telephone to replace its normal, relatively inefficient, antenna.

While it incorporates a suction cup permitting it to be easily mounted on any appropriate surface, and to be carried from location to location by the user, it may also be permanently mounted on a surface for use, for example, with other than hand-held cellular telephones.

Figure 1:
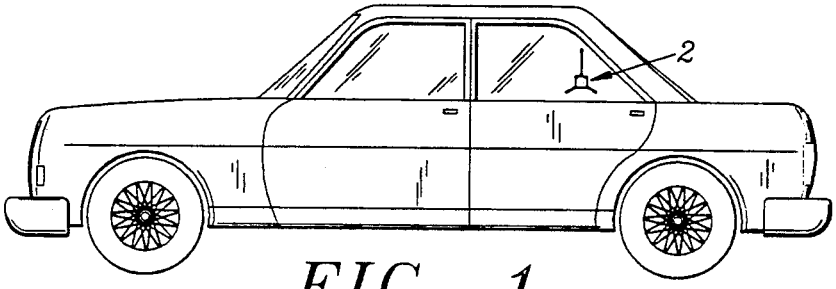
FIG. 1 is a side view of automobile showing the preferred unitary cellular telephone antenna of the present invention mounted on a rear window thereof.
Figure 2:
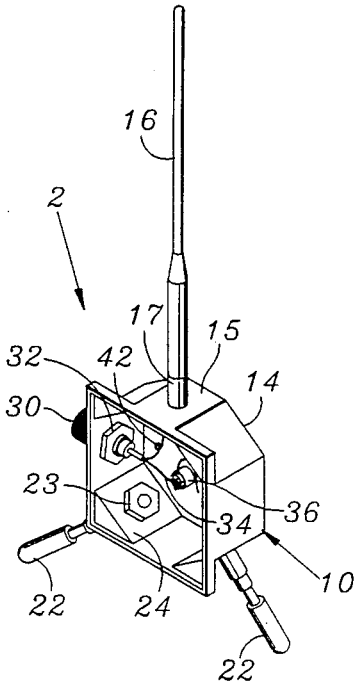
FIG. 2 is a view of an the preferred cellular telephone antenna assembly with the base cover of the junction box removed.
Figure 3:
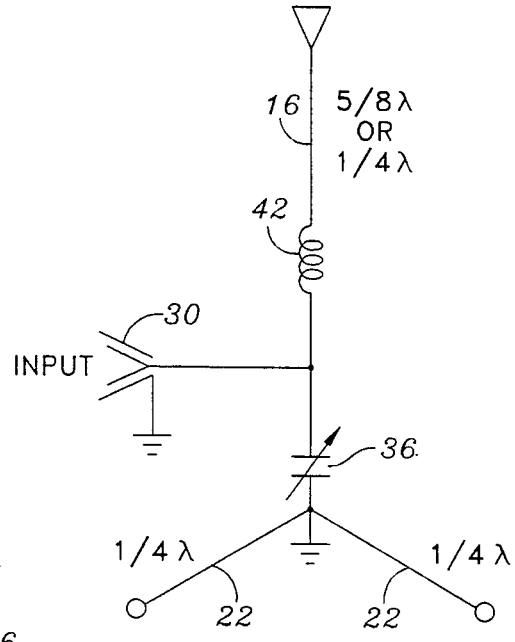
FIG. 3 is an electrical schematic of the preferred unitary cellular telephone antenna.
Figure 4:
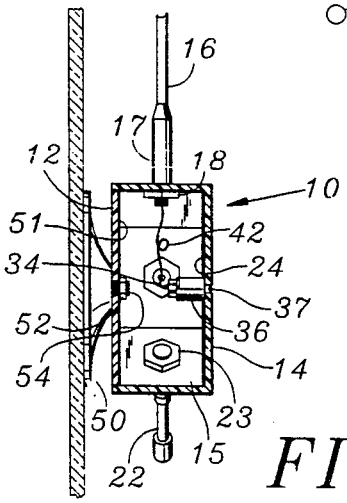
FIG. 4 is a partial view of the antenna assembly, in cross section, and its associated mounting surface.

As shown in FIG. 1, the unitary cellular telephone antenna 2 of the present invention may be mounted on a any window of a vehicle, and easily connected by a coax cable (not shown) to a portable cellular telephone to improve the range and reception of that telephone. It may, of course, be attached to any other appropriate surface. Its advantage is that it is as portable as a cellular telephone, yet when used significantly improves the range and reception of that portable telephone. A preferred construction of the unitary portable cellular telephone is shown in FIGS. 2 and 4. It includes a junction box 10 that is generally square on overall shape, with a removable flat base 12 that is approximately $1\frac{3}{4}$" along each edge. An outer face 14 is spaced a short distance from the base. Between the base and the outer face of the junction box are rectangular side faces 15, preferably eight in number, to provide three facets or planar surfaces at an angle of 120 degrees to one another.

An antenna element 16 is mounted to the top facet or planar surface of the junction box, and includes a threaded cylindrical shaft 17 that extends through an opening in the junction box and is received by a nut 18 which clamps the antenna to the junction box. Preferably the antenna is a $\frac{5}{8}$ wavelength element which, for typical cellular telephone systems in use in the United States, is approximately $8\frac{1}{4}$" long.

Two $\frac{1}{4}$ wavelength radial elements 22 are similarly mounted to side planar surfaces, or facets 15, of the junction box to project downwardly at an angle of approximately 120 degrees to the antenna element, the antenna element and radial elements preferably lying in the same plane. Underlying the nuts 23 which receive the threaded bases of the radial elements and clamp the radials to the junction box, are tabs of a conductive brass plate 24 that completely covers the inside face of the junction box, the tabs electrically connecting the radial elements to the plate 24.

A threaded female coax connector 30 is also mounted to a side facet of the junction box, as shown in FIG. 2, by a nut 32 received on the threaded interior end of the connector. An inductor 42 and the center terminal of the adjustable capacitor 36, electrically attaches the center conductor of connector 30 to antenna element 16, and serves as a loading coil. A capacitor 36 is received in a central opening in the brass plate 24 and is mounted on the face of the junction box. A slotted element 37 of the capacitor extends through the face of the junction box, and may be turned by a screwdriver to adjust the capacitance of the element.

By adjusting capacitor 36, the reactance of the loading coil 42 for the antenna may be balanced out and the antenna system matched to the 50 Ohm output impedance typically designed into cellular telephone transceiver systems to minimize the VSWR on the coax line. As a result, an antenna at maximum efficiency may be achieved. In the preferred construction, the present unitary telephone antenna offers substantially a 3 DB gain, as opposed to what usually is at best a 1 DB (or unitary) gain of most of the whip antennas mounted on portable cellular telephones.

As best shown in FIG. 4, preferably a suction cup 50 is mounted to the base of the junction box to attach the unitary antenna to an appropriate surface such as the side window of an automobile as shown in FIG. 1. In the preferred construction, a small metallized area 51 is provided on the interior surface of the base plate 12 of the junction box, and a nut 52 is soldered to this metallized interior surface to receive a threaded stud 54 extending from the suction cup through an appropriate opening in the base of the junction box. The base plate 12 is removably attached to the junction box by screws, for example.

The junction box may be more permanently attached to a surface, if desired, by simply removing the suction cup and using a double sided adhesive tape as the mounting means.

While the preferred embodiment of the present invention has been illustrated and described, variations in the construction of the unitary telephone antenna will be apparent to those skilled in the field. For that reason, the scope of the invention is not defined by the preferred embodiment, but instead is as set forth in the following claims.

I claim:

1. A unitary cellular telephone antenna assembly comprising:

a junction box having a plurality of planar surfaces;

a fractional wavelength antenna;

means mounting the antenna on one of the planar surfaces of the junction box so that when the junction box is mounted on a surface, the antenna projects generally vertically upward from the box;

a plurality of ground plane radial elements;

means mounting the radial elements on planar surfaces of the junction box such that the radial elements are angled downwardly relative to the horizontal plane perpendicular to the vertical antenna;

connector means mounted to the junction box for attaching the antenna and radial elements to a cellular telephone transceiver;

the junction box including a metalized area about an opening;

a nut being attached to the metalized area about the opening;

a suction cup; and a bolt received in the suction cup, the threaded shaft of the bolt being received in the nut to attach the suction cup to the junction box, whereby the antenna assembly may be conveniently attached by the suction cup to a relatively smooth surface.

* * * * *